US005140974A

United States Patent [19]

Whatley

[11] Patent Number: 5,140,974

[45] Date of Patent: Aug. 25, 1992

[54] TRASH BURNING BARREL COVER

[76] Inventor: Shawn W. Whatley, Rte. 1, Box 16A, Maysville, Okla. 73057

[21] Appl. No.: 731,693

[22] Filed: Jul. 17, 1991

[51] Int. Cl.[5] ..... F23J 11/00

[52] U.S. Cl. ..... 126/307 R; 126/223; 126/224; 126/312

[58] Field of Search ..... 126/307 R, 224, 225, 126/223, 222, 312

[56] References Cited

U.S. PATENT DOCUMENTS

| | | | |
|---|---|---|---|
| 2,001,360 | 5/1935 | Heuston | 126/224 X |
| 2,271,828 | 2/1942 | Peacock | 126/224 X |
| 2,877,834 | 3/1959 | Campbell | 126/307 X |
| 4,414,956 | 11/1983 | Webber | 126/225 X |
| 4,655,193 | 4/1987 | Blacket | 126/224 |

*Primary Examiner*—Larry Jones
*Attorney, Agent, or Firm*—Robert K. Rhea

[57] ABSTRACT

A cover for preventing unwanted fires starting by burning embers of refuse being burned in a barrel is formed by an irregular cone shaped base truncated by a substantially rectangular upstanding tubular throat portion having a rain cap surmounted thereon. The cover is hingedly connected with the barrel for pivoting it to a barrel top open chain arrested out-of-the-way position for placing trash in the barrel.

3 Claims, 1 Drawing Sheet

TRASH BURNING BARREL COVER

BACKGROUND OF THE INVENTION

1. Field of the invention

This invention relates to trash disposal and more particularly to a cover for a barrel in which trash is being burned.

In locales where refuse service pick-up is not available and environmental rules permit, many individuals burn their trash. A preferred way for fire safety is to utilize an empty 55 gallon capacity oil drum as a burn barrel for the burning of trash.

Such trash disposal is generally satisfactory in such a burn barrel. However, it presents a dangerous fire hazard in that embers or sparks flying from the top of the burn barrel is born by wind and may ignite nearby vegetation.

This invention provides a fire safety cover which not only minimizes the danger of flying sparks from a barrel incinerator but also increases the efficiency of disposing of trash by burning.

2. Description of the prior art

The prior art discloses refuse incinerators, some of which have a flat or dome shaped wire mesh cover, while others have a flat surface with a grill pattern in the flat surface.

This invention is distinctive over prior patents of which I am aware by providing a substantially cone shaped cover for a burn barrel with the cone shape truncated by a throat portion having a rain hood elevated over the top thereof.

Both the base of the cone shape and the top of the throat portion are provided with wire screen material for preventing burning embers flying from the barrel.

SUMMARY OF THE INVENTION

The burn barrel cover is formed by a substantially cone shaped base portion having its perimeter cooperatively received by the open perimeter of a burn barrel top.

The cone shape is hingedly connected to the upper end portion of the barrel wall and is provided with a lifting handle, opposite the hinged position, for vertical pivoting movement of the cover toward and away from the barrel top.

The cone shape is truncated by inserting the depending end portion of a generally rectangular tube intersecting the wall defining the cone shape.

A rain hood is surmounted on the open top of the tube in generally parallel upward spaced relation.

The base of the cone portion is provided with a diametrically equal screen and the tube open top is similarly spanned by a screen.

The principal object of this invention is to increase the efficiency of upright tubular incinerators and substantially eliminate fires caused by sparks or burning embers from burning refuse in trash barrels.

DESCRIPTION OF THE PREFERRED EMBODIMENTS

Figure 1:
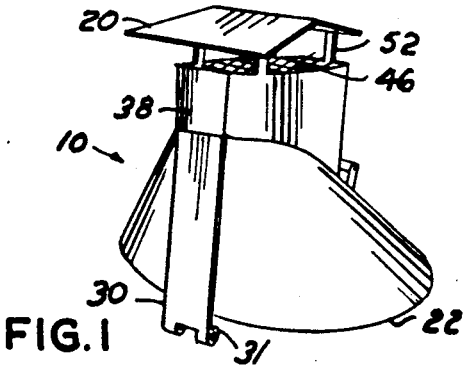
FIGS. 1 and 2 are perspective views of the incinerator cover, per se.
Figure 2:
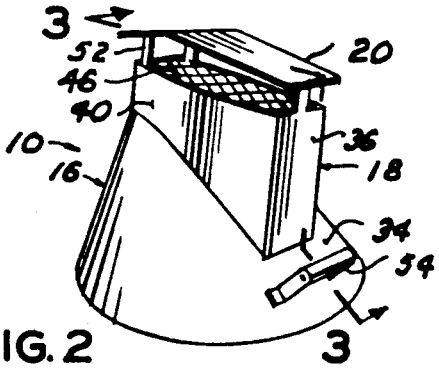

Like characters for reference designate like parts in those figures of the drawings int h which they occur.

In the drawings:

The reference numeral 10 indicates the cover overlying an empty conventional 55 gallon motor oil barrel 12 utilized as an incinerator for the disposal trash. The cover 10 is characterized by an irregular conical shaped base 16 truncated by a rectangular tubular portion 18 forming a burning gases throat having a surmounted rain cap 20 thereon.

The outside diameter of the cone base end 22 is slightly greater than the diameter of the open end of the barrel 12. The base or bottom end 22 of the cone 16 is preferably defined by an endless right angle member having one of its flanges 24 vertically disposed adjacent the inner periphery of the barrel upper wall portion with its other flange 26 horizontally disposed to overlie the top bead 27 at the barrel open end.

The depending edge of the vertical flange 24 is spanned by a screen 28 preferably ¾ inch 9 gauge flat expanded metal for rigidity and the reasons presently explained.

A band-like rearward portion 30 of the cone 16 is extended downwardly beyond the horizontal plane defined by the vertical flange 24 and has one-half of an interdigitated hinge 31 horizontally secured thereto. The other hinge half 31' is rigidly connected with the adjacent upper end portion of the barrel wall outer surface. The hinge pin 32 being removable for removing the cover from the barrel for emptying ashes and unburnable objects accumulating therein.

The forward portion 34 of the cone shaped wall and its upper limit is truncated by the rectangular throat 18, preferably having a cross sectional area of at least 152 sq.in. (981 sq. cm) to insure sufficient draft and is rigidly secured thereto as by welding, not shown.

The forward and rearward walls 36 and 38 of the throat are substantially parallel and its side walls 40 and 42 bulge outwardly slightly to obtain the desired cross sectional area of the throat.

The upper end surface 44 of the throat is substantially horizontal and parallel with the cone bottom flange 26 and is similarly bridged by expanded metal or wire mesh top screen 46. A similar screen 48, spaced downwardly from the top screen 46 horizontally spans the depending end portion of the throat to form an additional spark arresting screen.

The planar rain hood and damper 20 generally horizontally overlies the upper limit of the throat wall upper edge 44 in vertically spaced relation, being supported in this position by a plurality of upstanding strap-like posts 52. The overall dimensions of the rain hood 20 are slightly greater than the perimeter dimensions of the throat wall to minimize moisture falling therein.

Opposite the hinge 31, the cone forward wall portion 34 is provided with a horizontally disposed handle 54 secured by a pair of strap members 55 for the purpose of lifting the hood or cover 10 in a pivoting action about the hinge pin 32 for inserting trash or refuse into the barrel 12.

Figure 5:
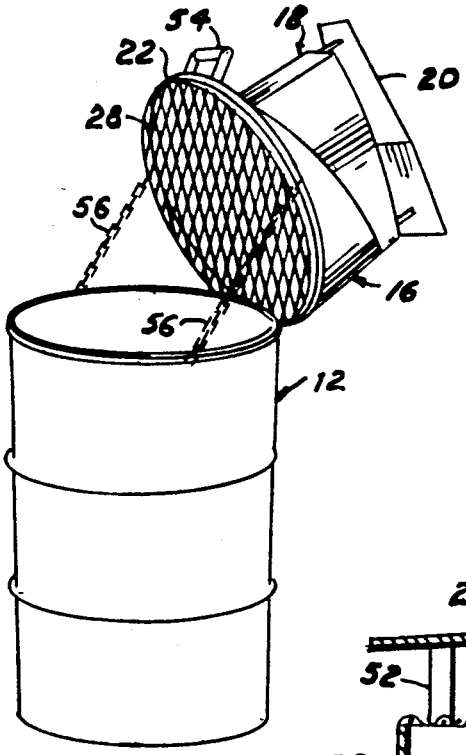
FIG. 5 is a perspective view of the cover in opened position relative to a barrel which it is hingedly attached.
Figure 4:
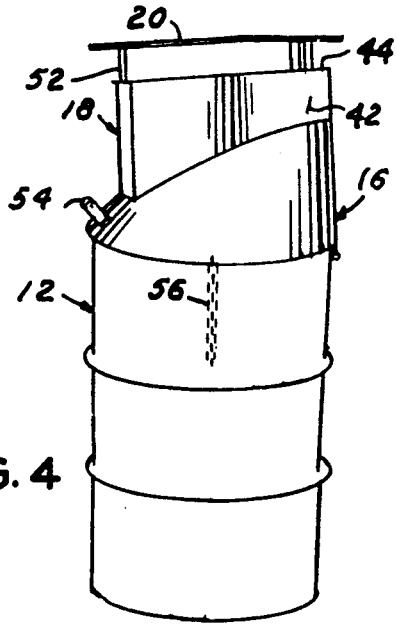
FIG. 4 is a perspective view of the cover in place on a barrel.
Figure 3:
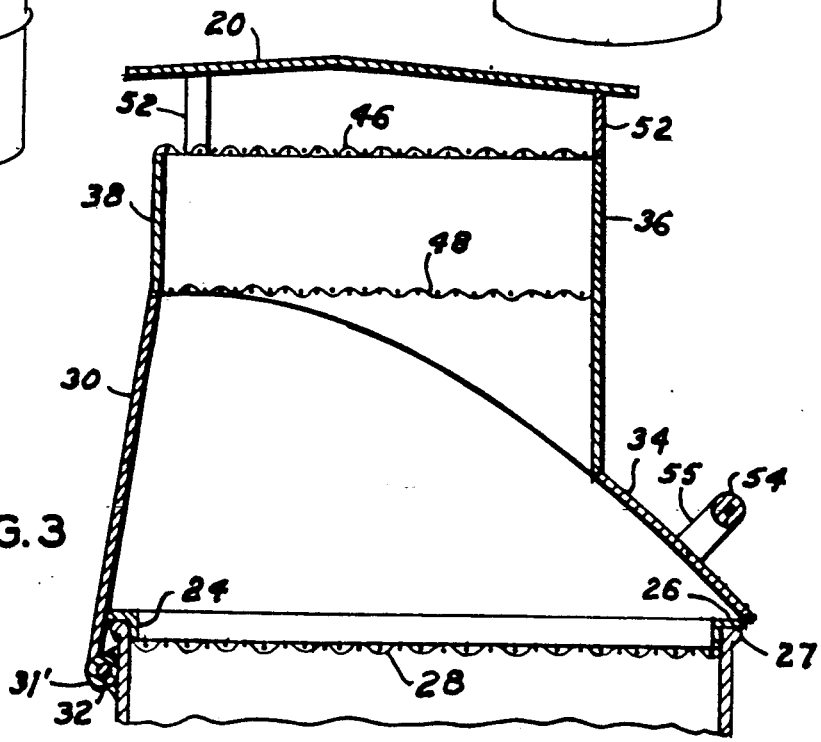
FIG. 3 is a vertical cross sectional view of the cover and a fragment of the barrel top portion to a larger scale, taken substantially along the line 3—3 of FIG. 2.

A pair of flexible elements 56, such as selected lengths of metallic chain, are secured at their respective ends to diametrically opposite positions of the cone bottom 22 and cooperating diametrically opposite positions of the upper limit of the barrel wall. The length of the chains 56 is selected so that when the cover 10 is pivoted to an upward open position, as illustrated by FIG. 5, the cover is held in this open position by gravity, arrested by the chains 56, for inserting refuse into the barrel 12.

Obviously the invention is susceptible to changes or alterations without defeating its practicability. Therefore, I do not wish to be confined to the preferred embodiment shown in the drawings and described herein.

I claim:

1. A ventilating cover for an upwardly open tubular incinerator, comprising:

base means including a flange portion overlying the upper limit of the incinerator and a down turned flange adjacent the inner periphery of the upper limit of the incinerator and a conical wall support by the overlying flange for centrally condensing a thermal stream of burning hydrocarbon gases in a vortex generating action;

upright tubular means truncating the conical wall for forming a thermal outlet throat;

shield means supported by the upper limit of said upright tubular means in substantially horizontal upwardly spaced relation for normally preventing moisture entering said upright tubular means; and, screen means transversely intersecting the thermal stream at the lower limit of the down turned flange, upper limit of the upright tubular means and intermediate the height of the latter for occluding passage of burning embers.

2. The ventilating cover according to claim 1 and further including:

hinge means connecting said cover to said incinerator for vertical pivoting movement of the cover toward and away from the incinerator; and, handle means secured to said cover opposite said hinge means.

3. The ventilating cover according to claim 2 and further including:

an elongated flexible strand connected at its respective end portions with the perimeter of said cover and said incinerator, respectively, remote from said hinge means for supporting said cover in an incinerator opened position.

* * * * *